US010398628B2

(12) United States Patent
Raghuprasad

(10) Patent No.: US 10,398,628 B2
(45) Date of Patent: Sep. 3, 2019

(54) 30 DAY PILL CUTTING DEVICE

(71) Applicant: Puthalath Koroth Raghuprasad, Odessa, TX (US)

(72) Inventor: Puthalath Koroth Raghuprasad, Odessa, TX (US)

( * ) Notice: Subject to any disclaimer, the term of this patent is extended or adjusted under 35 U.S.C. 154(b) by 141 days.

(21) Appl. No.: 15/692,734

(22) Filed: Aug. 31, 2017

(65) Prior Publication Data

US 2019/0060173 A1 Feb. 28, 2019

(51) Int. Cl.

| | |
|---|---|
| ***A61J 7/00*** | (2006.01) |
| ***B26D 3/30*** | (2006.01) |
| ***B26D 7/01*** | (2006.01) |
| ***B26D 5/10*** | (2006.01) |
| *A61J 3/06* | (2006.01) |
| *B26D 1/08* | (2006.01) |

(52) U.S. Cl.

CPC ..... *A61J 7/0007* (2013.01); *B26D 3/30* (2013.01); *B26D 5/10* (2013.01); *B26D 7/01* (2013.01); *A61J 3/06* (2013.01); *B26D 1/08* (2013.01)

(58) Field of Classification Search

CPC ..... A61J 7/0007

See application file for complete search history.

(56) References Cited

U.S. PATENT DOCUMENTS

| | | | |
|---|---|---|---|
| 2,655,259 | A | 10/1953 | Francis |
| 4,055,892 | A | 11/1977 | Del Vecchio |
| 4,173,826 | A | 11/1979 | Heinrich |
| 4,179,806 | A | 12/1979 | Lieptz |
| 4,199,863 | A | 4/1980 | Deckert |
| 4,422,553 | A | 12/1983 | Hoeks |
| 4,473,192 | A | 9/1984 | Urban |
| 4,697,344 | A | 6/1987 | Leopoldi |
| 4,694,996 | A | 9/1987 | Siegel |
| D305,960 | S | 2/1990 | Wolff |
| 5,118,021 | A | 6/1992 | Fiocchi |
| D467,664 | S | 8/2001 | Chue |
| 6,474,525 | B1 | 11/2002 | Reitano |
| 6,557,945 | B1 | 5/2003 | Chue |
| 6,601,746 | B2 | 8/2003 | Buckley |
| 6,644,528 | B1 | 11/2003 | Reitano |
| 6,968,987 | B1 | 11/2005 | Reitano |

(Continued)

FOREIGN PATENT DOCUMENTS

| | | |
|---|---|---|
| CN | 201023244 | 2/2008 |
| JP | 2002325824 | 11/2002 |
| WO | 9219207 | 11/1992 |

*Primary Examiner* — Kenneth E Peterson

(74) *Attorney, Agent, or Firm* — David L. King

(57) ABSTRACT

A multiple pill cutting device has a pivoting housing structure holding a blade holding assembly. The pivoting housing structure has a top housing pivotably connected at one end to a bottom housing. The bottom housing has a plurality of pill holding openings arranged in one or more rows. The one or more rows of pill holding openings have a slotted channel extending along a length of the bottom housing through and bisecting each pill holding opening. The blade holding assembly has one or more extending cutting blades. One blade is configured to align with each slotted channel when the top housing pivots closing onto the bottom housing, this moves the one or more cutting blades of the blade holding assembly to enter the slotted channels and cut pills held in the pill holding openings.

18 Claims, 19 Drawing Sheets

(56) References Cited

U.S. PATENT DOCUMENTS

| | | | | |
|---|---|---|---|---|
| 7,000,815 | B1 | 2/2006 | Tipton et al. | |
| 7,252,254 | B1 | 8/2007 | Engel et al. | |
| 7,275,671 | B1 | 10/2007 | Reitano | |
| 7,503,471 | B2 | 3/2009 | Iwasaki | |
| 8,550,319 | B2 | 10/2013 | Raghuprasad | |
| 2003/0084574 | A1 | 5/2003 | Eric | |
| 2005/0193885 | A1 | 9/2005 | Lykam | |
| 2006/0138190 | A1 | 6/2006 | Williams | |
| 2009/0031872 | A1 | 2/2009 | Lykam | |
| 2015/0209236 | A1* | 7/2015 | Patel | A61J 7/0007 225/103 |
| 2015/0257978 | A1* | 9/2015 | Smith | A61J 7/0007 225/103 |
| 2017/0128324 | A1* | 5/2017 | Muller | B26D 1/26 |

* cited by examiner

30 DAY PILL CUTTING DEVICE

TECHNICAL FIELD

The present invention relates to an improved pill or tablet cutting device and more particularly to a pill cutter for simultaneously cutting a plurality of pills.

BACKGROUND OF THE INVENTION

Medicines can be delivered in the shape or form of a pill, caplet or tablet. These pills or tablets provide a dosage of medicine that can be administered to the patient. Oftentimes the amount contained in the tablet is more than is required for a patient and in order to get the proper dosage it is convenient to split the tablet in half or even quarters. Oftentimes the need arises to cut the pills in halves or even quarters. Increasingly, in order to save money, the patient buys a pill of higher strength and cuts them to reduce the cost. Those pharmacies which supply medications to nursing homes and similar institutions may also be involved in cutting a large number of pills. To achieve this, a variety of pill cutters have been provided, almost all are designed to cut a single pill. Some of these are described in U.S. Pat. Nos. 6,474,525; 7,275,671; 7,000,815; 5,118,021 and U.S. design Pat. 467664. Each of these pill cutter or pill splitter devices has a limitation as it can handle only one pill at a time. In U.S. design 305960 a two-pill compartment is provided on a hinged surface.

When a patient needs to cut a plurality of pills or more than one pill, very few devices are available. In U.S. Pat. No. 4,697,344 a multi-pill cutter is described which accomplishes the objective of allowing a number of pills to be cut simultaneously. In order to achieve this, a resilient pad has been put in a container; the pad has a plurality of holes in it to accept pills of a particular size. This pad holds the pills directly above a plurality of cutting blades; as the top cover which includes a second solid resilient pad is closed, the pills are pushed against a blade and are split. This advantageously enables a large number of pills to be simultaneously cut in half. As shown in this prior art patent, approximately 30 pills of an elongated shape can be cut. A disadvantage of this design is that to provide different sizes, different pads have to be provided with different hole sizes. Therefore, the device is limited to one particular size pill. As further illustrated, the resilient pad on the top cover must press down on the pill in such a fashion that each pill is cut; in order to accomplish this in such a large base the pressure has to be uniformly applied such that one does not push on one side or the other of the container or top lid in such a fashion that the load is not uniform and therefore pills at one end of the device are not cut through.

Accordingly, while this device achieves the goal of cutting simultaneously as many as 30 pills, it does so in such a fashion that it is limited to one particular size per cut and further by the fact that it can only cut the pills in half. This device is further limited by the fact that it requires a rather strong uniform pressure to achieve a desired breaking of all the pills.

In still another embodiment described in US publication 2009/0031872 an automatic pill cutter is illustrated wherein large supplies of pills can be cut automatically which enables the dispensing of large numbers of pills to be achieved. The drawback of this particular automated device is likely expensive and is ideally suited mainly for a pharmaceutical company as opposed to an individual patient or pharmacy.

Another prior art device, U.S. Pat. No. 8,550,319; of Dr. Raghuprasad is designed to load pills in a removable nest. Yet another pill cutter is on the market to cut multiple pills in a single row up to 10 pills, if care is taken to align properly. This manufacturer or distributor is called Cibolo Press, LLC of Houston Tex.

To overcome these drawbacks of cutting pills to achieve a reduced dosage for a patient, the present invention provides a means of cutting a large number of pills simultaneously, while also being configured to accommodate a variety of different sized pills such that a variety of pill sizes can be cut simultaneously to achieve half dosages.

SUMMARY OF THE INVENTION

A multiple pill cutting device has a pivoting housing structure holding a blade holding assembly configured to cut up to 15 pills which will provide a 30-day supply. The pivoting housing structure has a top housing pivotably connected at one end to a bottom housing. The bottom housing has a plurality of pill holding openings arranged in one or more rows. The one or more rows of pill holding openings have a slotted channel extending along a length of the bottom housing through and bisecting each pill holding opening. The slotted channel is configured to receive a pill cutting blade. The blade holding assembly is interposed between the top housing and the bottom housing. The blade holding assembly has one or more extending cutting blades. One blade is configured to align with each slotted channel when the top housing pivots closing onto the bottom housing. This moves the one or more cutting blades of the blade holding assembly to enter the slotted channels and cut pills held in the pill holding openings.

Each pill holding opening is a modified heart shaped cavity having a larger flat opening at a first end for receiving elongated pills, tablets or caplets and a curved substantially circular or round curvature at an opposing end for holding circular or round pills.

Each pill holding opening has a bifurcated sloped bottom having a pair of downward extending bottoms. Each bottom is deepest at the first end or second end of the opening, a first bottom being adjacent the first end and configured to support elongated pills and the second end configured to support circular or round shaped pills, wherein the sloped bottoms have the pills inclined or tilted in each pill holding opening.

The blade holding assembly further has an upper blade holding portion having the one or more cutting blades fixed thereto; a lower blade shield portion with blade slots, one blade slot being aligned with each of the one or more cutting blades; a plurality of fasteners connecting the upper blade holding portion to the lower blade shield portion at a plurality of attachment posts; and a plurality of springs encircling the plurality of attachment posts. Upon closing the device, the lower blade shield portion moves upwardly and compresses against the bottom housing as the cutting blades enter the slotted channels to cut the pills. The blade holding assembly is affixed to the top housing at a pivot location, wherein the pivot location is positioned between longitudinal ends of the blade holding assembly, preferably located midway relative to the longitudinal ends. The blade holding assembly moves relative to the top housing about the pivot location upon cutting the pills.

The top housing has a longitudinal contoured stiffening spine projecting and extending from inside the top housing for pushing against the upper blade holding portion of the blade holding assembly, wherein the stiffening spine has a contour which is maximum depth at the pivot of the blade holding assembly allowing the cutting blades to move parallel to the bottom housing of the device. The contoured stiffening spine and the top housing are further reinforced by a plurality of transverse ribs and the one or more cutting blades are configured to cut pills simultaneously when the pills are all of a same size and a same shape.

The device, when loaded with circular or round pills, is tilted toward the circular or round portion of the modified heart shaped openings, the pills nest in the pill holding openings and center about the slotted channel. The device, when loaded with elongated pills, is tilted toward the flat portion of the modified heart shaped opening, the pills nest in the pill holding openings and center about the slotted channel. The cutting blades engage the nested pills horizontally relative to the bottom housing and cut the pills on an angular cut due to the sloped bottom of each pill holding opening. The pivoting housing structure and blade holding assembly are injection molded plastics. Preferably, the injection molded parts are made from high density polyethylene or other suitable materials. The one or more cutting blades are sharpened steel, or other suitable materials like ceramic, by example. Preferably, the one or more cutting blades are stainless steel.

BRIEF DESCRIPTION OF THE DRAWINGS

The invention will be described by way of example and with reference to the accompanying drawings in which.

DETAILED DESCRIPTION OF THE INVENTION

Figure 1:
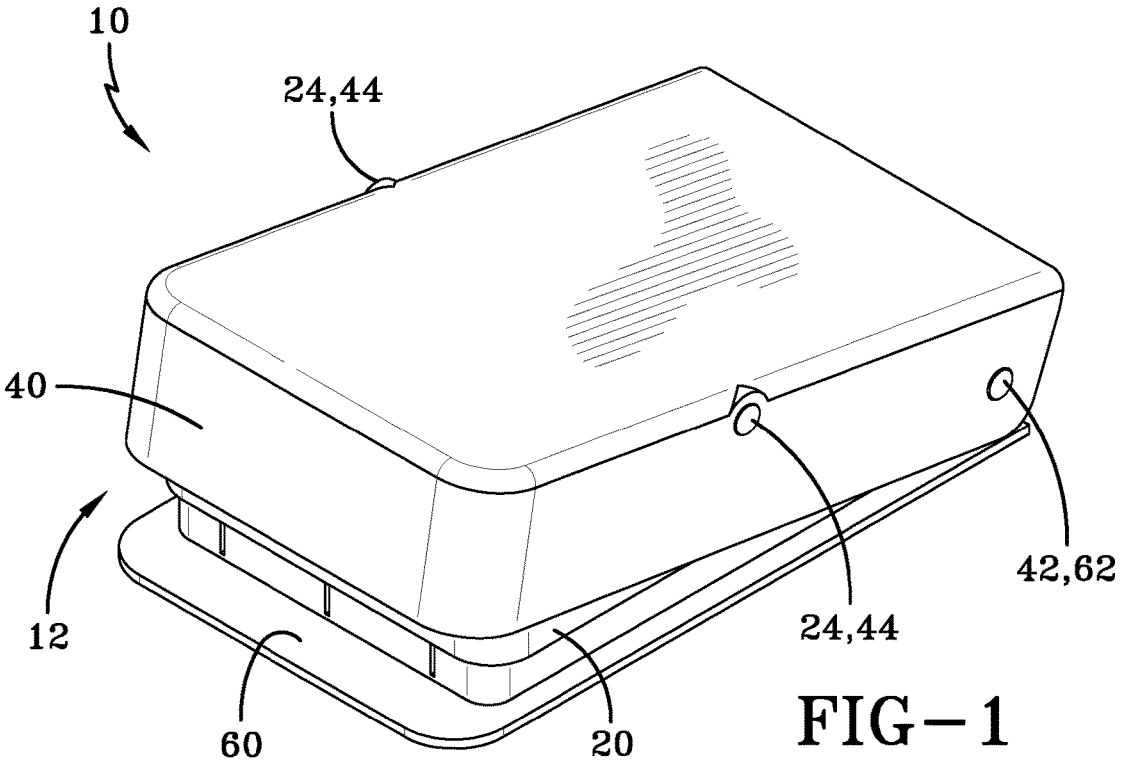
FIG. 1 is a frontal perspective view of the improved multiple pill cutting device of the present invention in a partially closed position.
Figure 2:
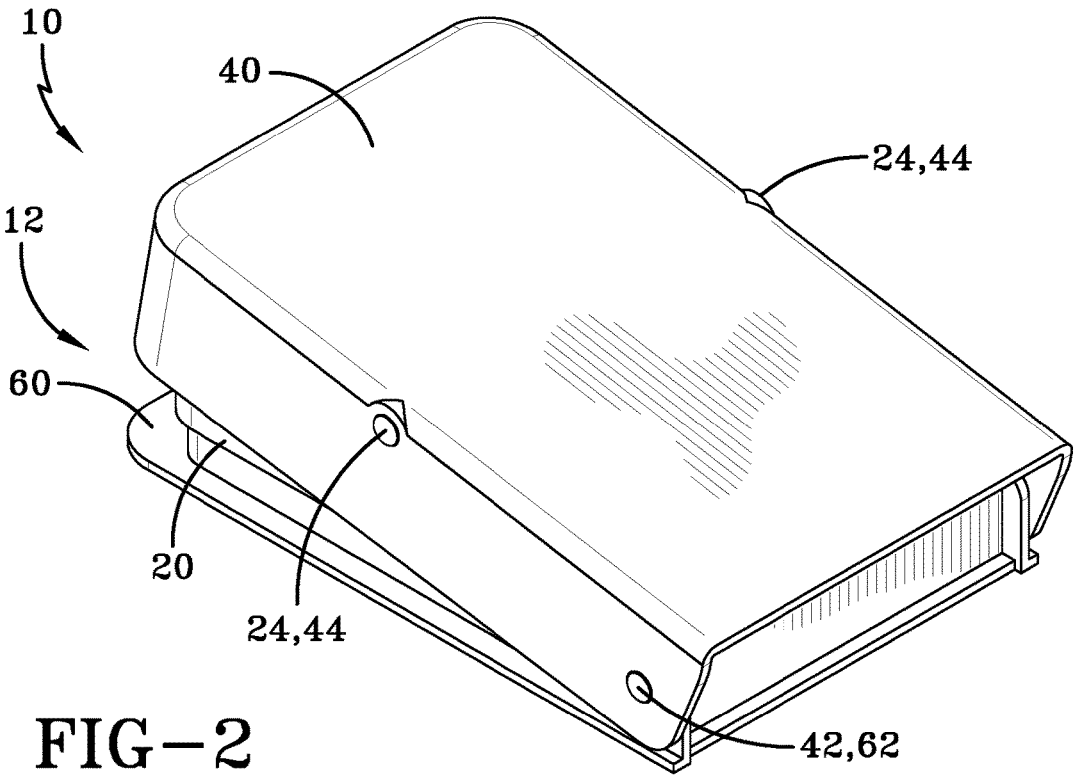
FIG. 2 is a rearward perspective view of the improved multiple pill cutting device of FIG. 1 in a partially closed position.
Figure 3:
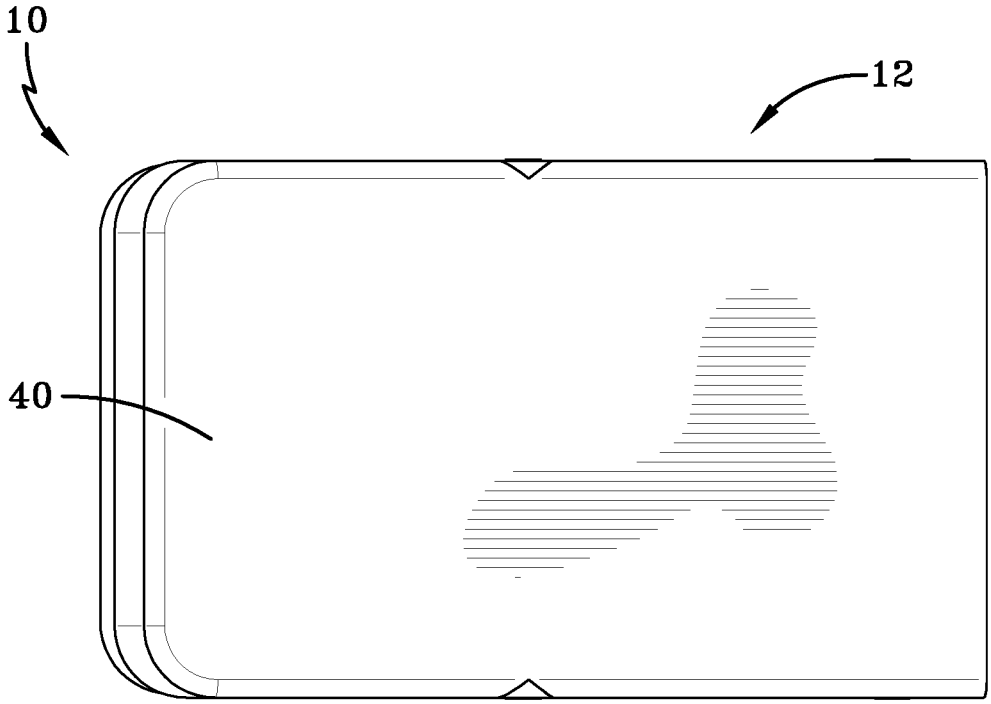
FIG. 3 is a top plan view of the device of FIG. 1.
Figure 4:
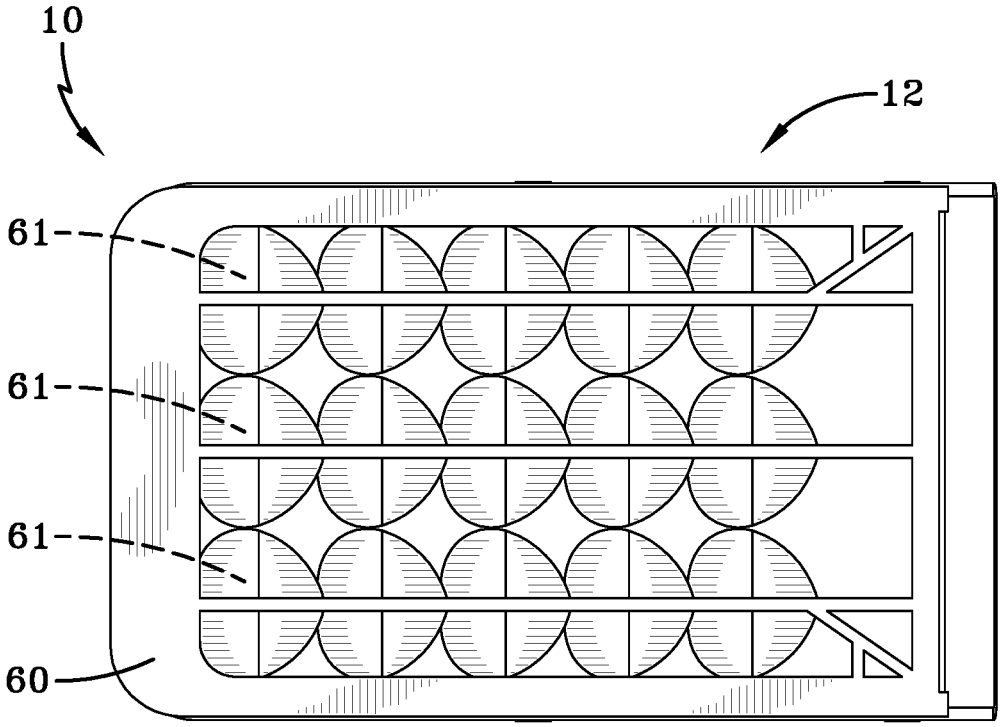
FIG. 4 is a bottom plan view of the bottom housing of the device.

With reference to FIG. 1, a multiple pill cutting device 10 is shown. The device 10 has a pivoting housing structure 12 with a top housing 40 pivotally connected to a bottom housing 60. The top housing 40 has a hole or opening 42 on each sidewall of the top housing 40. The hole 42 fits over a projecting pivot pin 62 on each side of the bottom housing 60. Interposed between the top housing 40 and bottom housing 60 is a blade holding assembly 20. The blade holding assembly 20 is illustrated in FIGS. 1 and 2 wherein the device is shown in a partially open configuration with the top housing partially closed. FIG. 3 shows a top view of the device 10. FIG. 4 shows a bottom plan view of the bottom housing 60. A plurality of pill holding opening 61 are arranged in rows as illustrated. The openings 61 are arranged in rows of 3 columns, each column having five pill holding openings 61 in the illustrated embodiment. More or less openings can be used. What is interesting, the fifteen pill holding openings 61 provide a device 10 that can cut 15 pills into 30 pieces or pill halves allowing the device 10 to effectively produce a 1 month supply of cut pills for the user or 30-day supply. Each opening 61 is shown bisected by a slotted channel 63. This slotted channel 63 extends from a first end of the bottom housing 60 forward to an opposite end of the bottom housing 60. This slotted channel 63 will allow a blade to pass through and cut the pills as will be discussed later.

Figure 5:
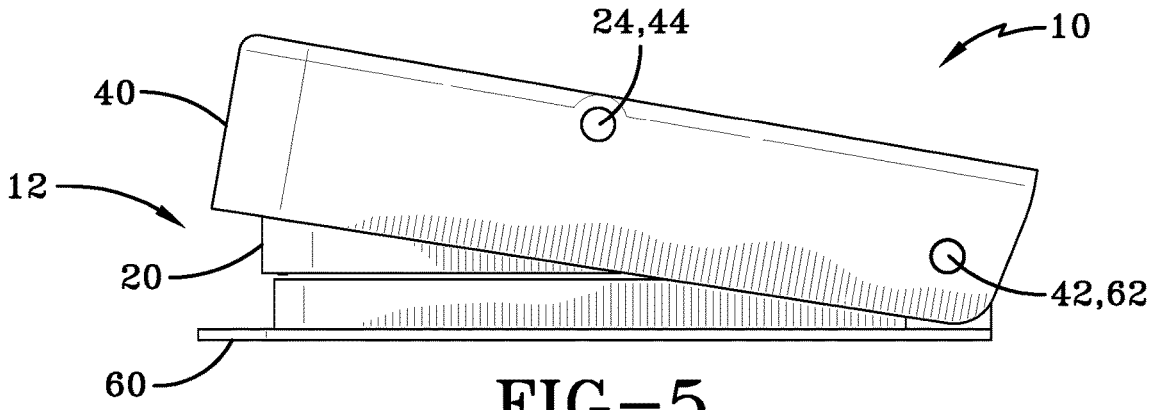
FIG. 5 is a side view of the device shown in FIG. 1.
Figure 6:
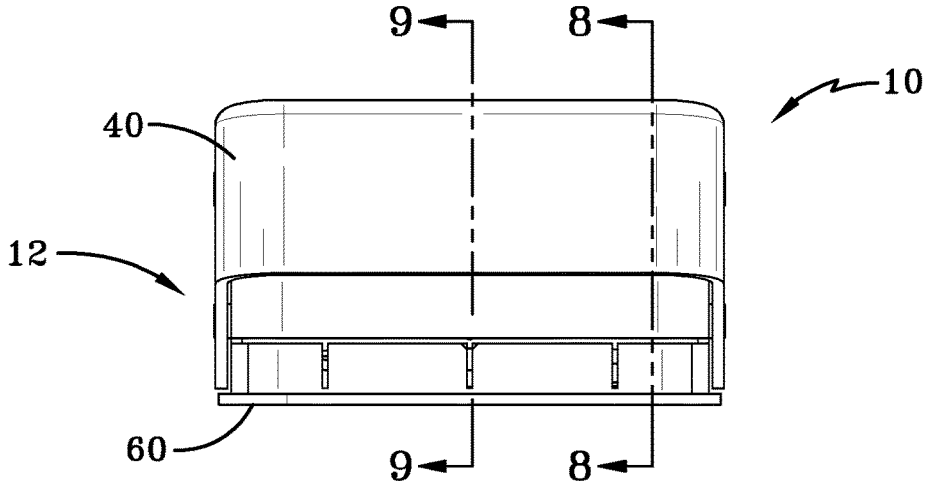
FIG. 6 is a front plan view of the device of FIG. 1.
Figure 7:
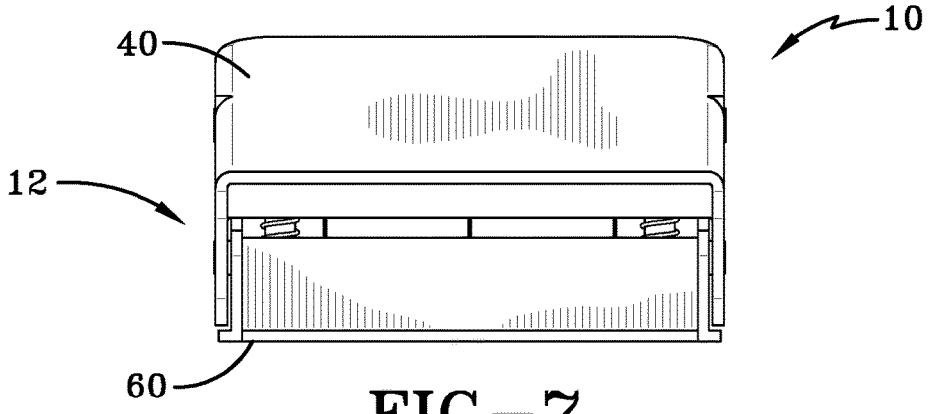
FIG. 7 is a rear plan view of the device of FIG. 1.

With reference to FIGS. 5, 6 and 7; the device 10 is shown from a side view in FIG. 5 where the pivoting end with the opening 42 and pivot pin 62 shown at the pivot end. The blade holding assembly 20 is shown attached to the top housing 40 at a pivot 24 that extends through a hole or opening 44 of the top housing 40. With reference to FIG. 6, a frontal view is shown where the device 10 is partially open. In FIG. 7, a rearward view of the device 10 is shown.

Figure 8:
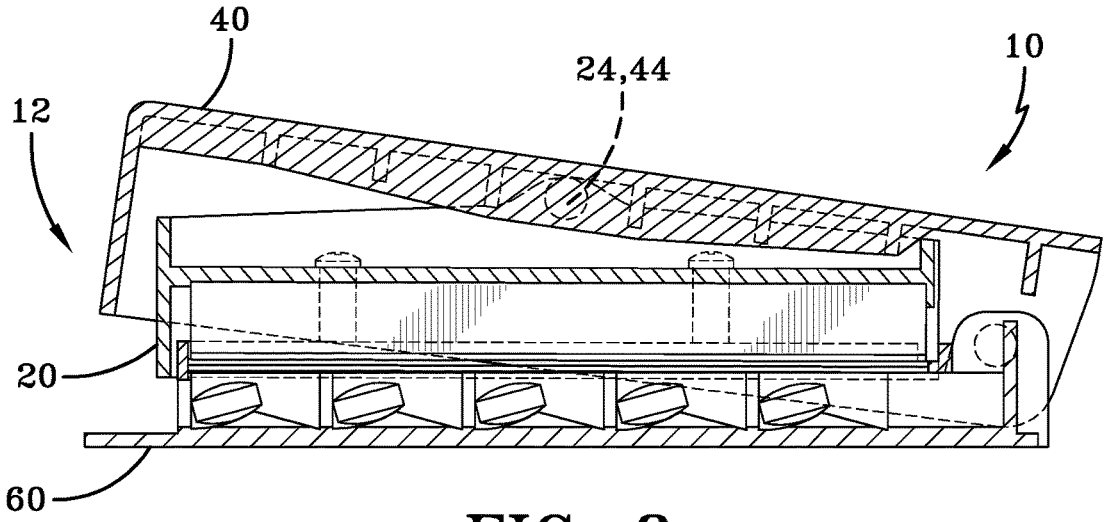
FIG. 8 is a longitudinal cross-sectional view taken along line 8-8 of FIG. 6.
Figure 9:
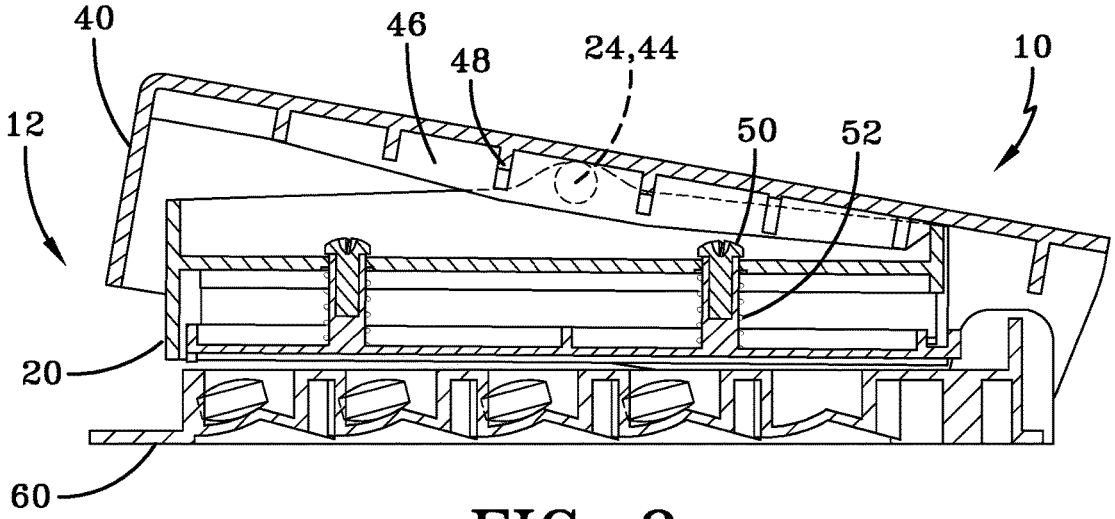
FIG. 9 is a longitudinal cross-sectional view taken along line 9-9 of FIG. 6.

With reference to FIG. 6, line 8-8 defines a cross-sectional view of the device 10 as illustrated in FIG. 8. As shown in FIG. 8, the device 10 has the blade holding assembly 20 positioned between the top housing 40 and the bottom housing 60. As illustrated in FIG. 8, a plurality of elongated pills 2 are shown in the pill holding openings 61. The blade 70, as illustrated in FIG. 8, is in a retracted position held in the blade holding assembly 20. With reference to FIG. 9, a second cross-sectional view taken along line 9-9 of FIG. 6, a top housing 40 has a stiffening spine 46 that extends longitudinally from a first end to a second end inside the top housing 40 is shown. This stiffening spine 46 is centered approximately on the top housing 40 and is reinforced by transverse ribs 48 that stiffen the entire top housing 40 so that the top housing 40, upon closing, can push the blade holding assembly 20 to drive the blades 70 into cutting engagement with the pills 2 held in the openings 61.

Figure 10:
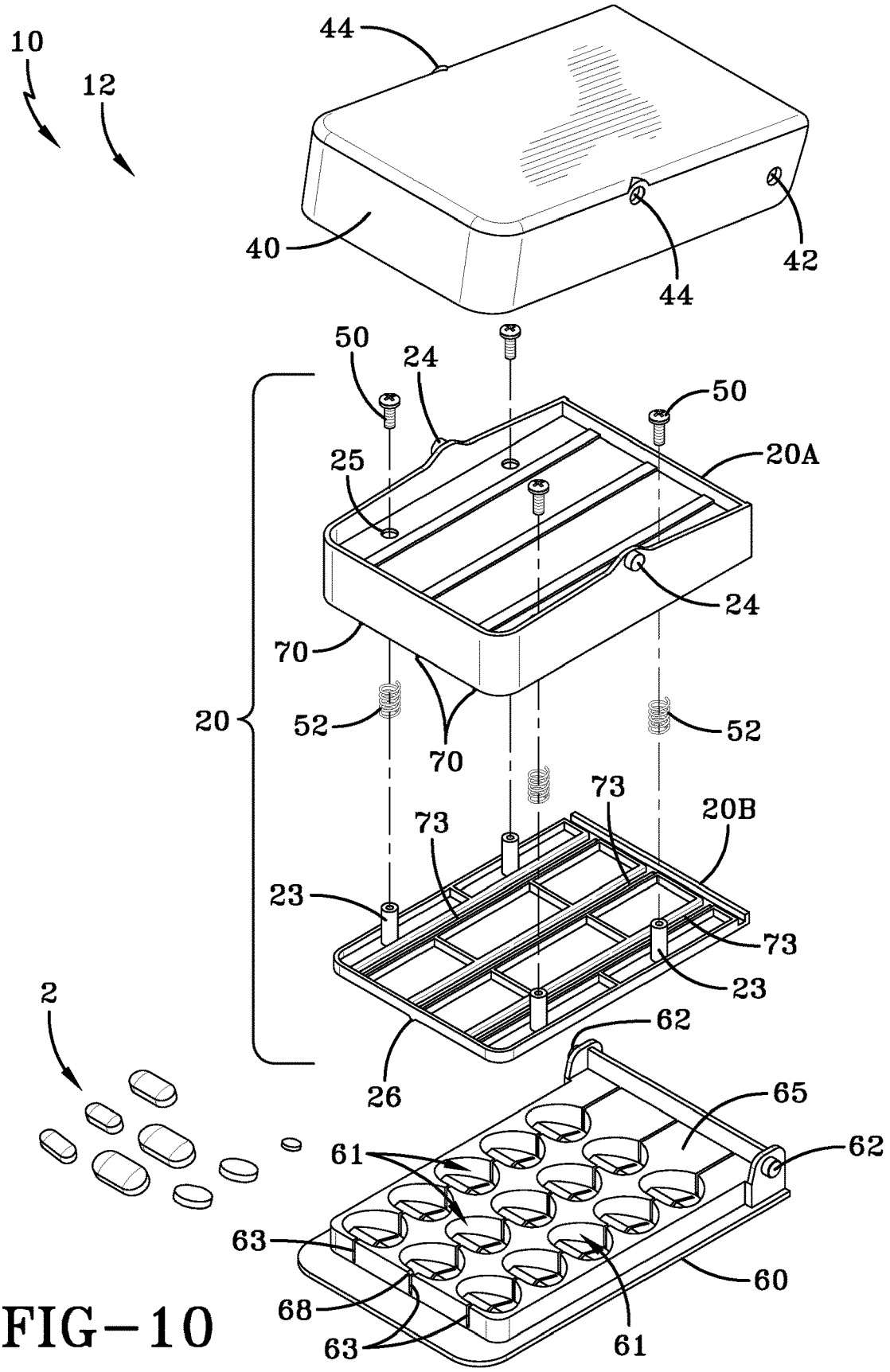
FIG. 10 is an exploded frontal perspective view of the device of the present invention with an additional view of exemplary pills of various shapes and sizes shown.
Figure 11:
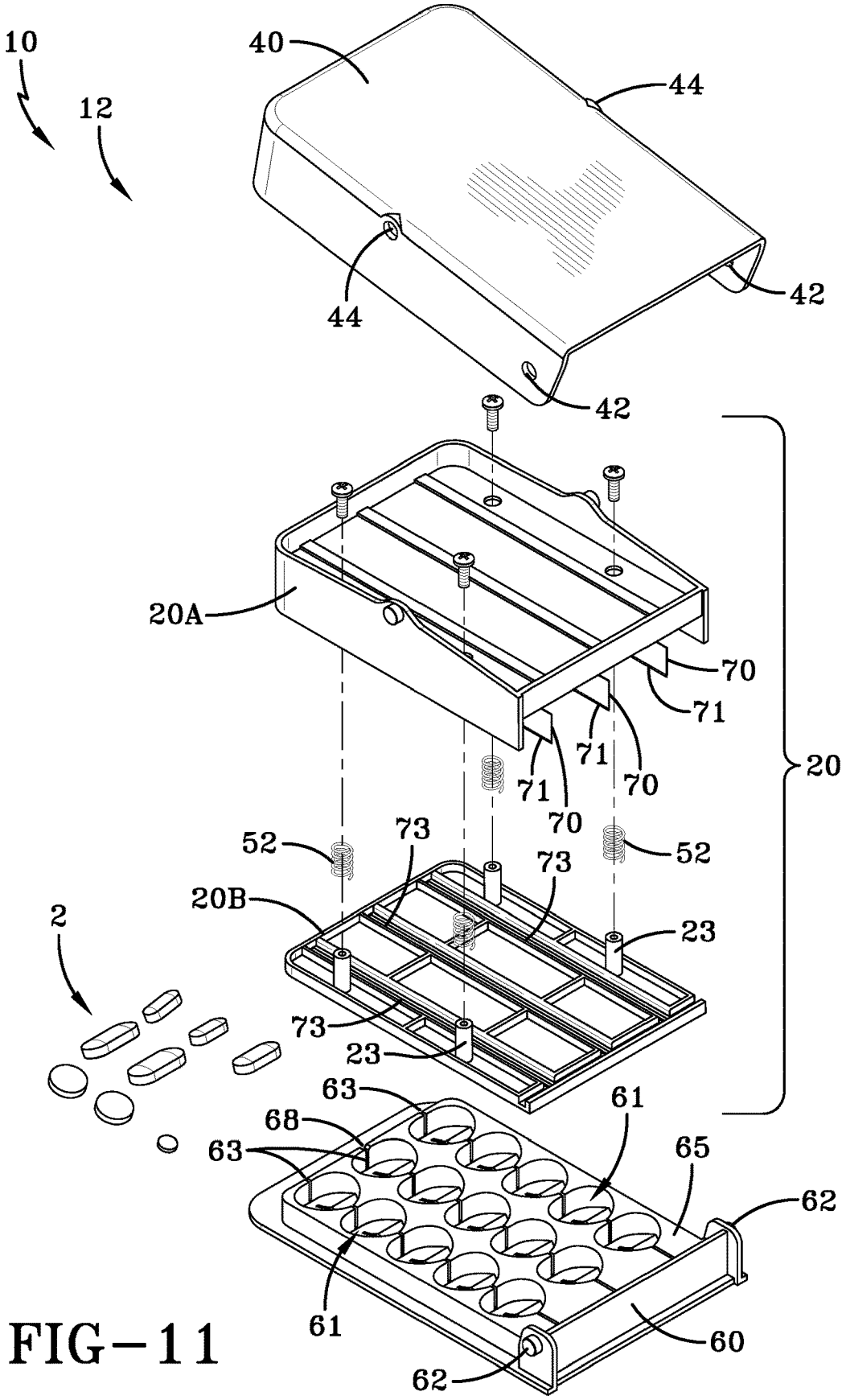
FIG. 11 is a rearward perspective exploded view of the device according to the present invention in a fully open position.

To better appreciate the device 10, an exploded view is illustrated in FIG. 10. In FIG. 10, the top housing 40 is shown with a hole 44 for holding the blade holding assembly 20 and a pivot hole 42 at a pivoting end of the top housing 40. Below the top housing 40, a blade holding assembly 20 is illustrated. The blade holding assembly 20 has a top portion 20A that holds the blades 70. The blades 70 are fixed to the top portion 20A, as illustrated, the top portion 20A has pivot pins 24 that fit into the holes 44 of the top housing 40 that allow the blade holding assembly 20 to rock or pivot inside the top housing 40. A lower blade shield portion 20B of the blade holding assembly 20 is illustrated. The blade shield portion 20B has a plurality of posts 23, as shown 4 posts 23 that are configured to fit through openings 25 in the top portion 20A held with fasteners 50. Encircling each post 23 is a compression spring 52. The compression springs 52 bias the top portion 20A from the shield portion 20B so the blades 70 are retained inside the blade holding assembly 20 and concealed by the shield portion 20B. The shield 20B has a plurality of elongated blade slots 73 for allowing the blades 70 to pass through the shield 20B when the device 10 is closed to cut pills. The pills 2 can be in a variety of shapes, as illustrated in a lower portion of FIG. 10. The pills 2 can be oblong or elongated in shape or circular or round in shape. The bottom housing 60 is shown with the pivot 62 at the pivoting end of the device 10. The bottom housing 60 has a plurality of openings 61, as previously discussed. Each row or column of pill holding openings 61 is bisected by a slotted channel 63. These slotted channels 63 extends through the bottom of the pill holding openings 61 to allow the blades 70 to pass through and cut the pills 2 when the device 10 is closed. FIG. 11 is a similar view to that of FIG. 10 only from a rearward perspective.

Figure 12:
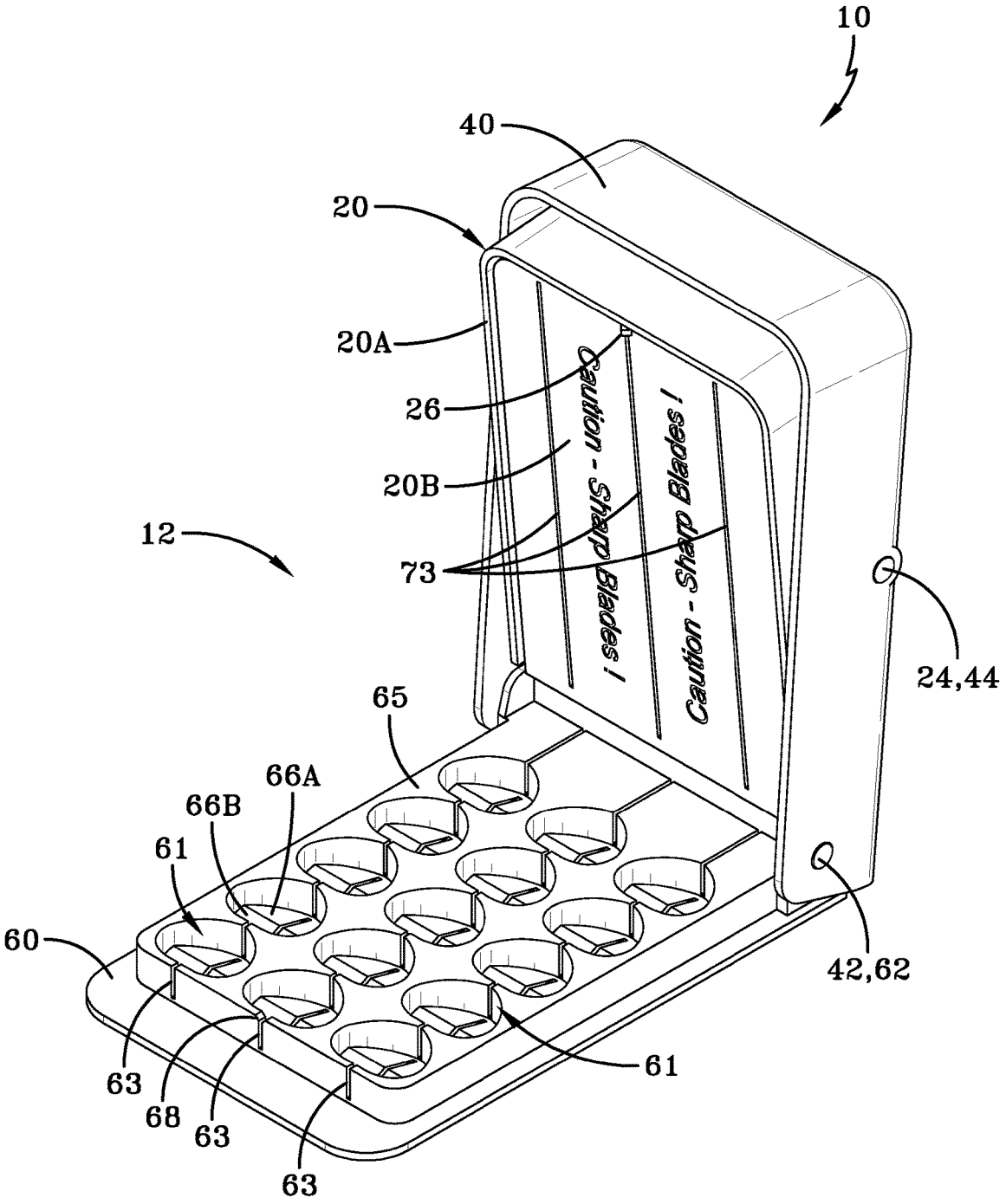
FIG. 12 is a frontal perspective view of the device according to the present invention in a fully open position.
Figure 13:
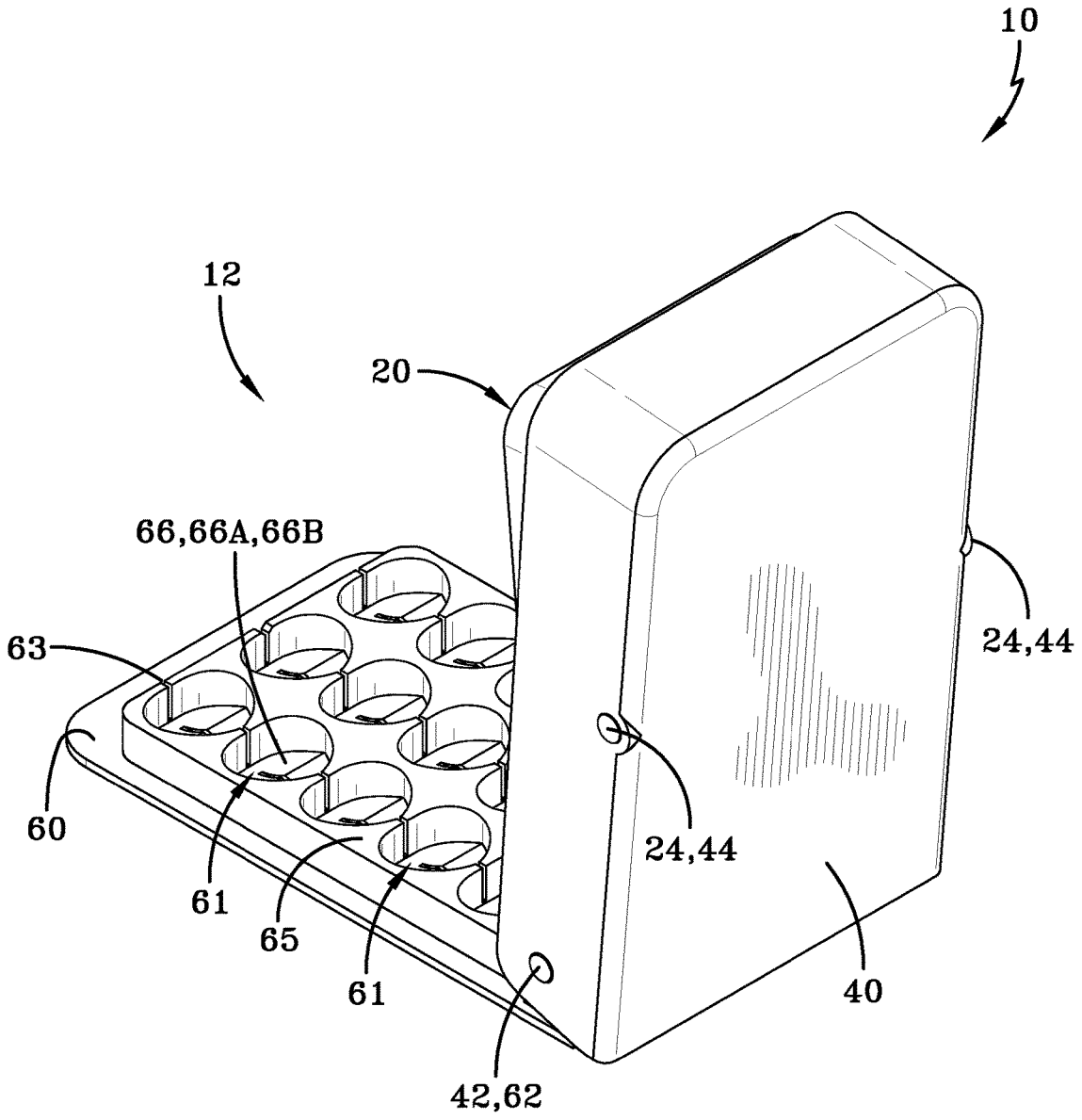
FIG. 13 is a rearward perspective view of the device according to the present invention in a fully open position.

With reference to FIG. 12 the device is shown in a fully open position where the blade shield 20B is shown concealing the blades 70 of the blade holding assembly 20. As shown, the blade holding assembly 20 is shown pivoted slightly inside the top housing 40 pivoting about the pin 24. The bottom housing 60 has the pill holding openings 61. The pill holding openings 61 are somewhat oval in shape having a flattened portion with a maximum width and a somewhat circular or round opposing portion extending from an opposite side. The flattened portion is configured to receive elongated pills and the circular or round portion is configured to receive circular or round pills. Each opening 61 has an inclined first bottom 66A for holding circular or round pills and an inclined second bottom 66B for holding the elongated pills on an incline. This bifurcated bottom 66 allows the pills 2 to be inclined oppositely, in other words, the elongated pills 2 will be inclined facing in one direction and pointing towards the middle of the opening 61 and the circular or round pills 2 will be inclined at an opposite end. During the cutting process, only one pill is used in each opening 61. It is believed preferable. This is further illustrated in FIG. 13 showing a rearward perspective of the device 10 in the open position.

Figure 14:
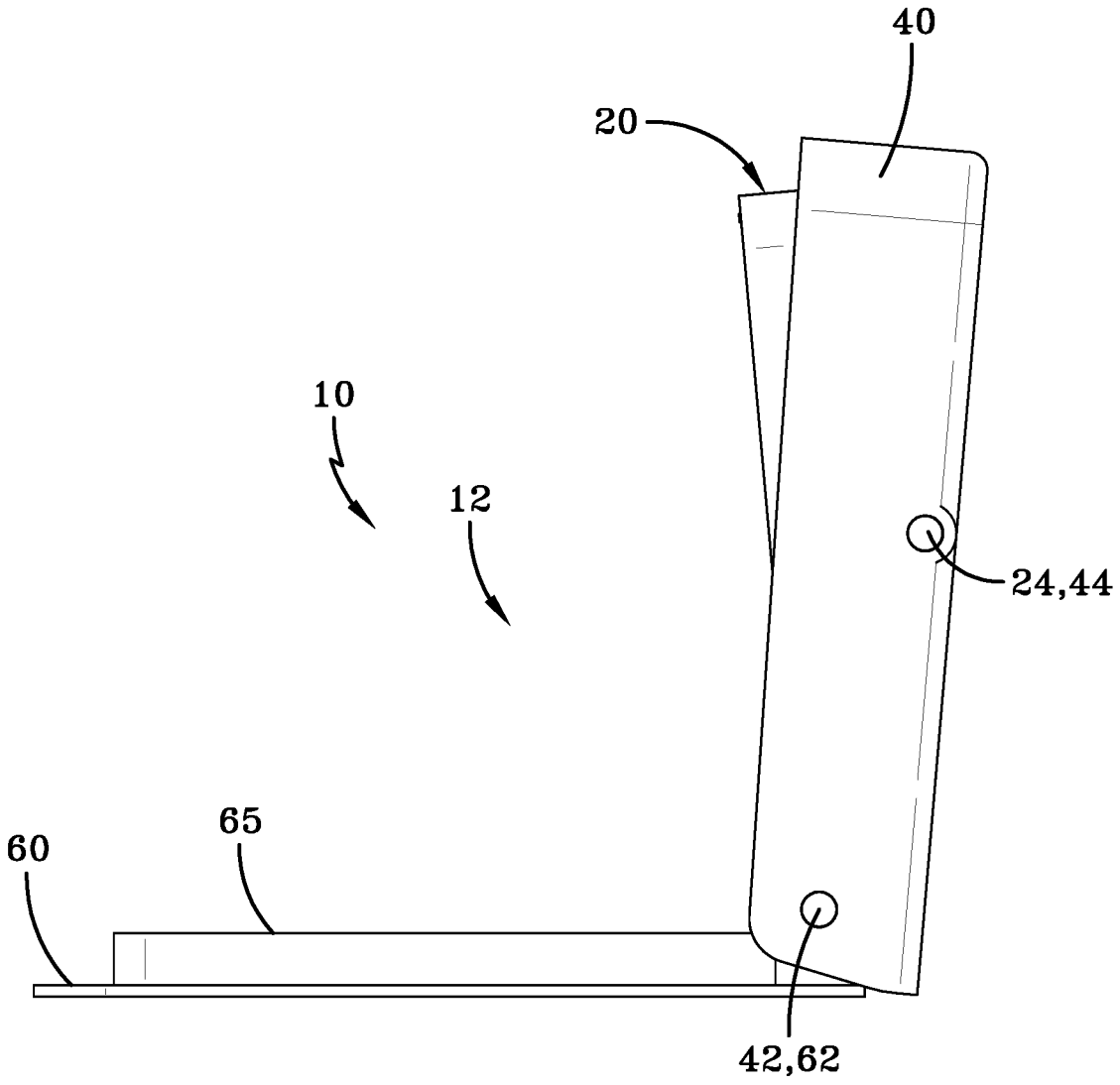
FIG. 14 is a side view of the device in a fully open position.
Figure 15:
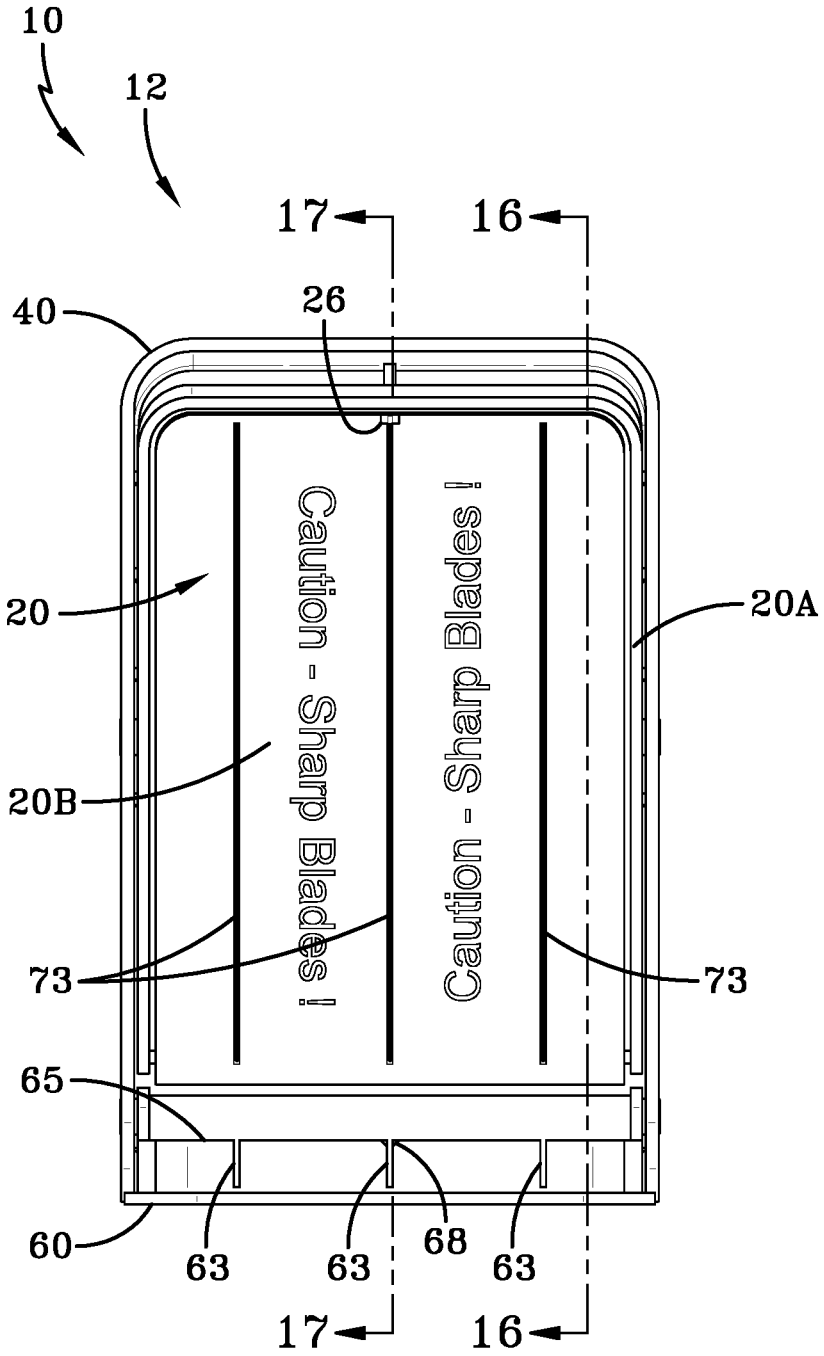
FIG. 15 is a frontal view of the device of the present invention in the fully open position.
Figure 16:
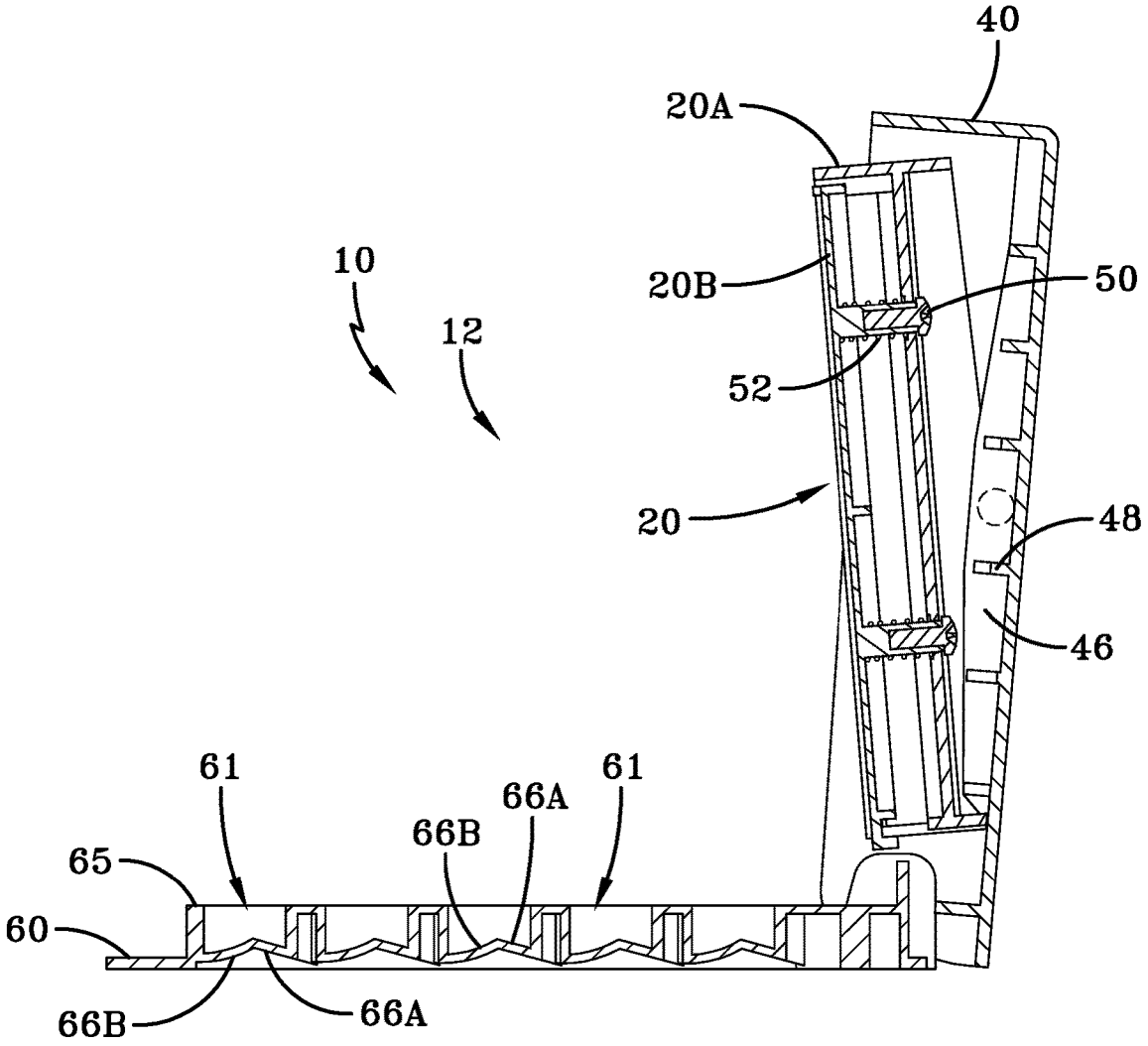
FIG. 16 is a longitudinal cross-sectional view taken along line 16-16 of FIG. 15.

In FIG. 14 a side view of the open device 10 is illustrated and in FIG. 15 a frontal view of the fully open device 10 is illustrated. In FIG. 15, line 16-16 and line 17-17 are lines extending for illustrating cross-sectional views of the open device 10 in FIGS. 16 and 17 respectively. As shown, the blade holding assembly 20 is illustrated inclined slightly outwardly pivoting about the pivot 24. As better shown in FIG. 16, the inclined bottom with the first bottom 66A for circular or round pills and second inclined portion 66B for holding the elongated pills 2 is illustrated in cross-section.

Figure 17:
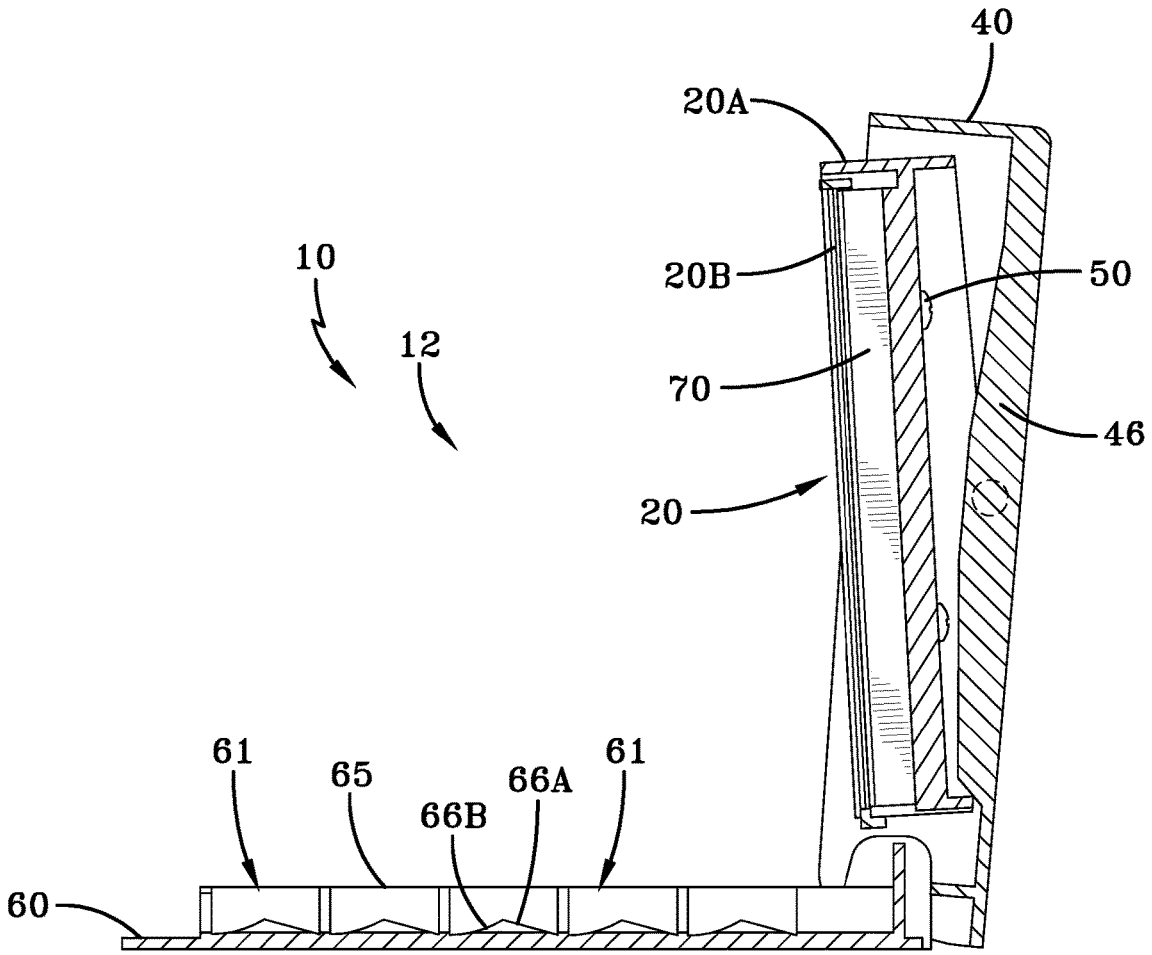
FIG. 17 is a longitudinal cross-sectional view taken along line 17-17 of FIG. 15.

With reference to FIG. 17 taken along line 17-17 of FIG. 15, a second cross sectional view is shown. In this cross-sectional view, blades 70 are clearly shown being held between the shield portion 20B and the top portion 20A in the blade holding assembly 20. In this open position, the cutting edges 71 of the blades 70 are safely retracted to prevent accidental cuts when loading the pills 2.

Figure 18A:
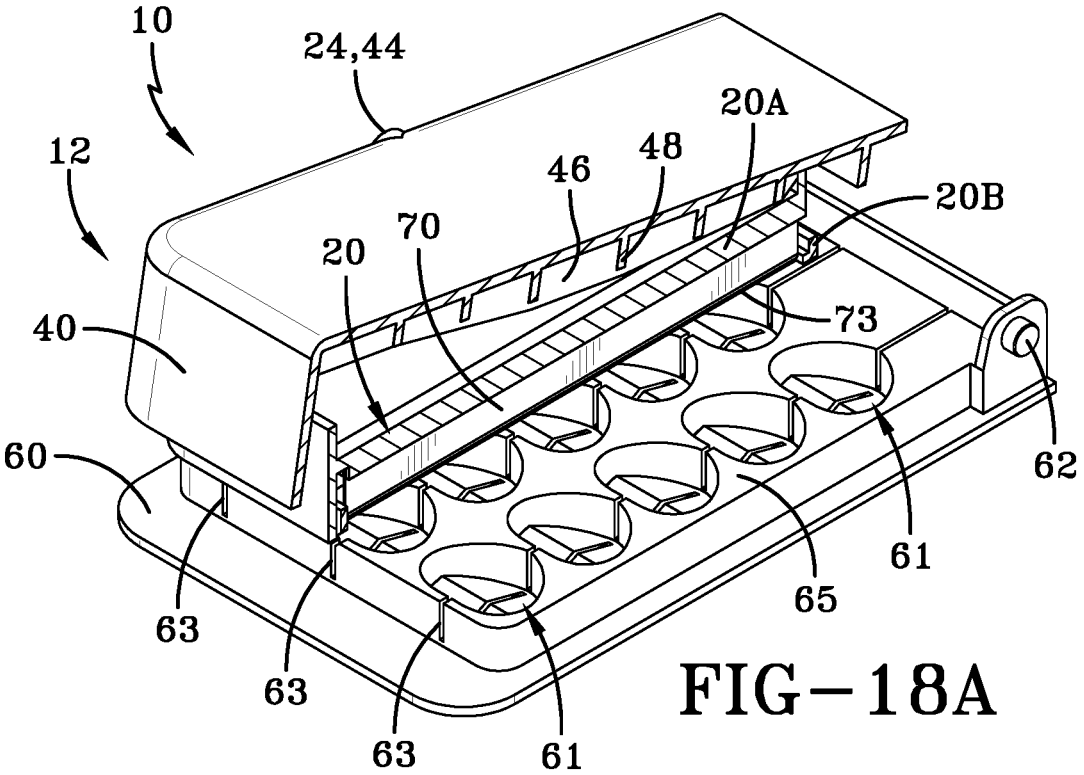
FIG. 18A is a frontal partial longitudinal cross-sectional view of the device in a partially closed position.
Figure 18B:
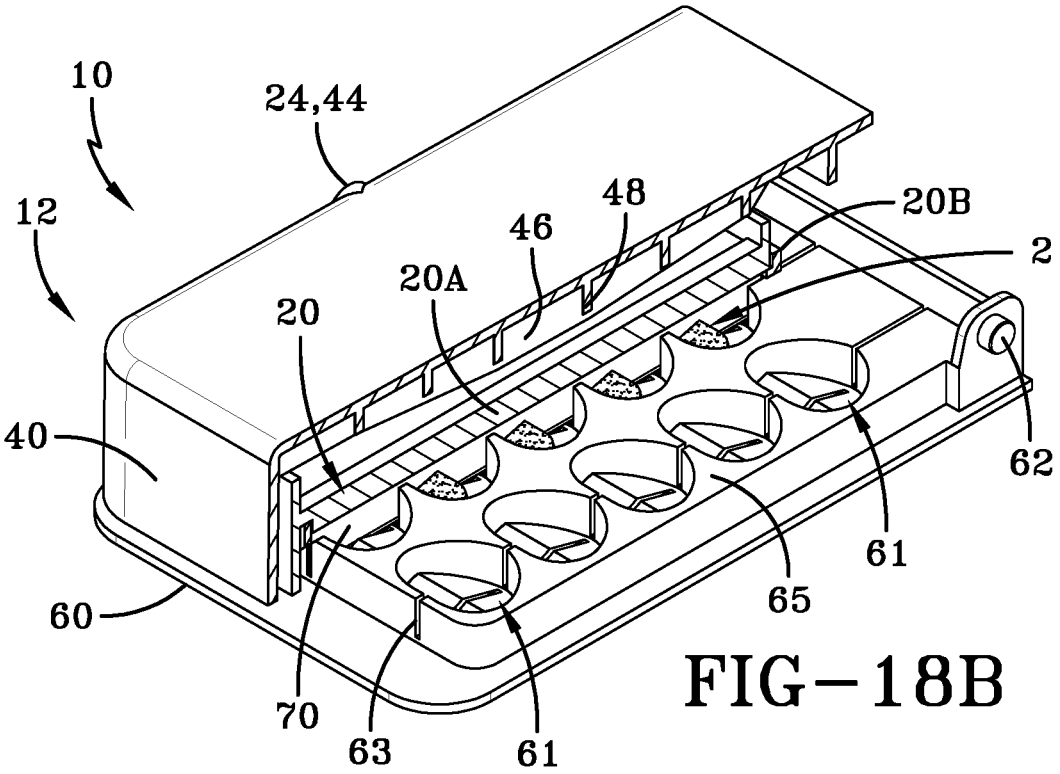
FIG. 18B is a frontal partial longitudinal cross-sectional view of the device in a fully closed position.
Figure 19A:
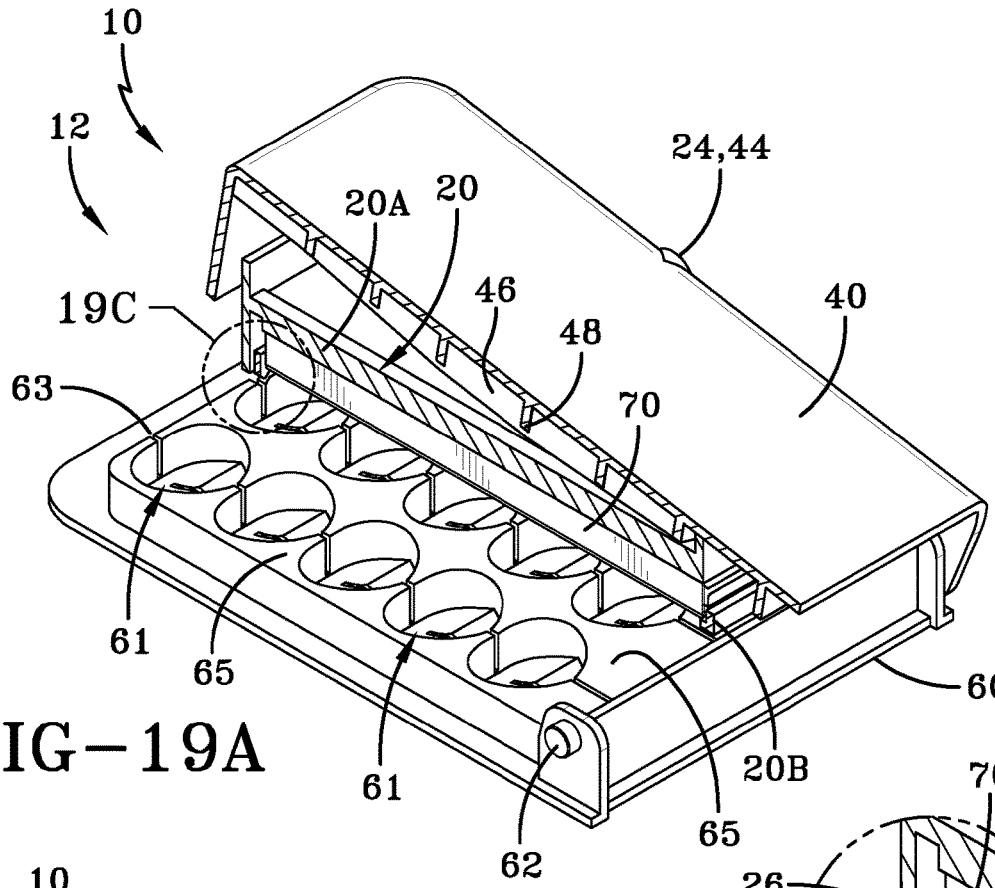
FIG. 19A is a rearward partial longitudinal cross-sectional view of the device in a partially closed position.
Figure 19C:
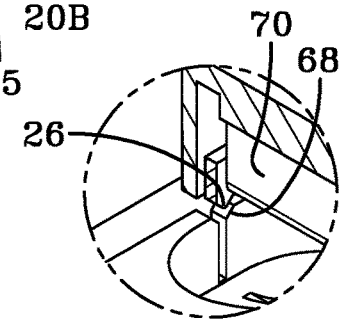
FIG. 19C is an enlargement taken from FIG. 19A showing the alignment point on the blade holding assembly and the complimentary receiving area in the bottom housing.
Figure 19B:
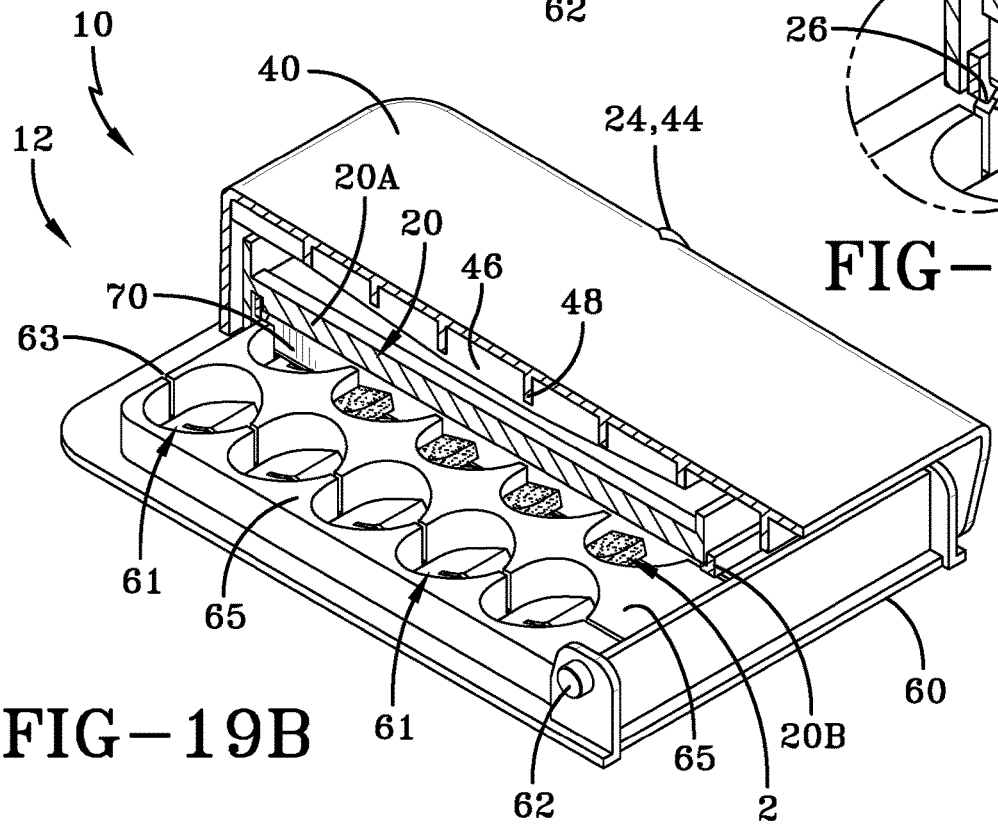
FIG. 19B is a rearward partial longitudinal cross-sectional view of the device in a fully closed position.
Figure 20A:
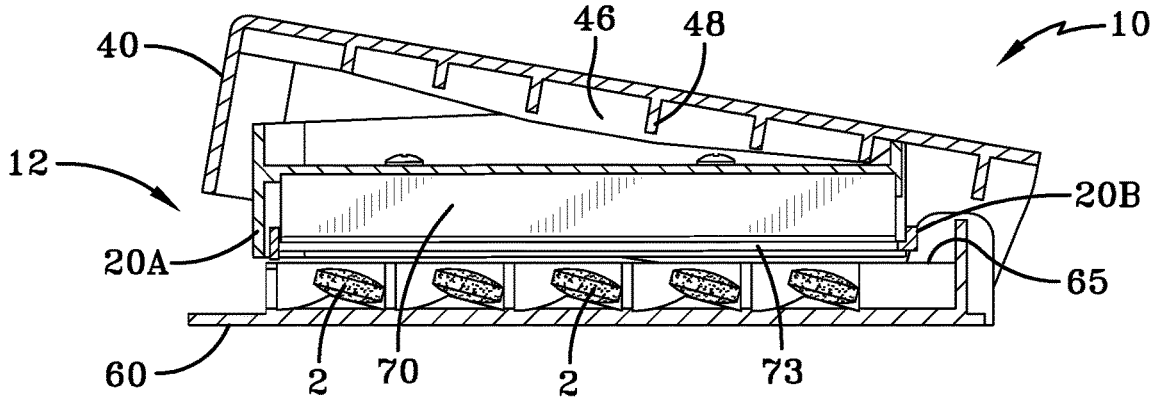
FIGS. 20A, 20B and 20C show the device in a longitudinal cross-sectional view prior to blades cutting pills, initiating blade contact with pills and after cutting pills in the fully closed position respectively.
Figure 20B:
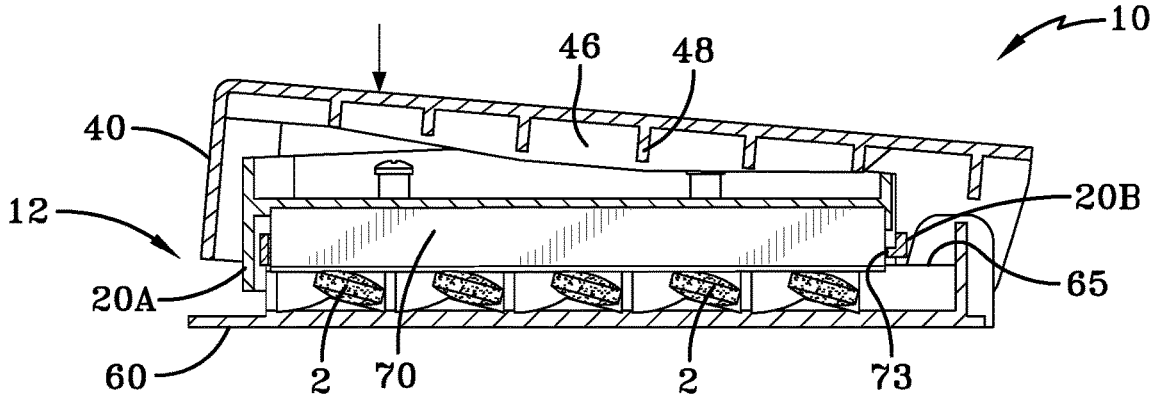
Figure 20C:
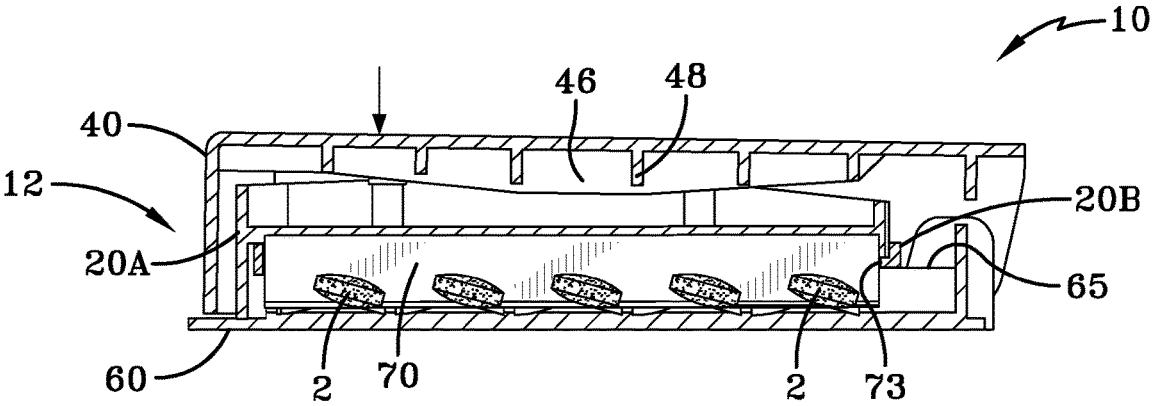
Figure 21:
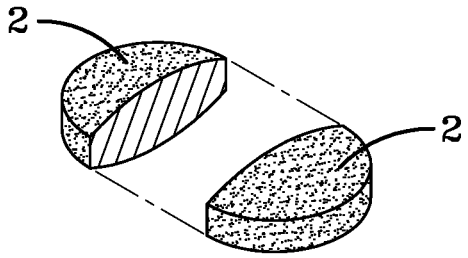
FIG. 21 shows an exemplary circular or round pill after being cut.
Figure 22:
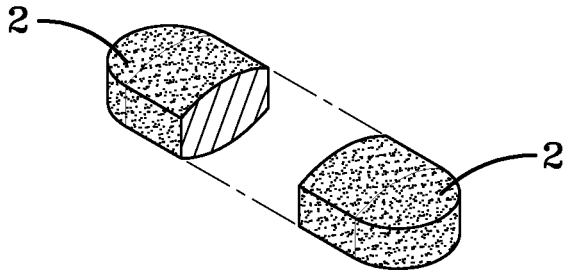
FIG. 22 shows an exemplary elongated pill after being cut.

With reference to FIGS. 18A and 18B showing a frontal view and FIGS. 19A and 19B showing a rearward view, the device 10 is illustrated in a partially closed position. Interestingly, in this position, the shield 20B rests on a top surface 65 of the bottom housing 60. The shield 20B resting on this surface 65 has the blades 70 still in a retracted position within the blade holding assembly 20. As illustrated, the stiffening spine 46 is initiating engagement with the top portion 20A of the blade holding assembly 20. In FIG. 18B, when the top housing 40 is fully closed, the stiffening spine 46 pushes directly on the top portion 20A driving the blades 70 into the slotted channels 63 of the bottom housing 60. As shown, the contoured stiffening spine 46 is at a maximum depth at a location aligned with the pivots 24 and holes 44 which are located midway along the length of the top housing 40. This alignment means the cutting forces applied are centered on the device 10 both longitudinally and transversely. The top housing 40 is reinforced by stiffening transverse ribs 48 and the stiffening spine 46 to ensure the top housing 40 does not bow or flex, but rather uniformly contacts the pills 2 to be cut. This is particularly the case when all the pills 2 loaded in the device 10 are of the same size and shape. The blades 70 will contact the pills 2 simultaneously and the blade holding assembly 20 being able to pivot about pivot 24 allows the blades 70 to cut horizontally relative to the bottom housing 60 even though the top housing 40 is moving arcuately about the pivot 42. The blades 70, as illustrated, will extend into the bifurcated pill openings allowing the blade edges 71 to initiate cutting at a top surface of the pills 2, as illustrated in FIGS. 20A and 20B. After the blades 70 engage the top portion of the pills, they will cut into the pills cutting the pills 2 into two halves, as shown in FIG. 20C. The cut pills 2 are shown in FIGS. 21 and 22 respectively where a circular or round pill 2 is shown cut in half and an elongated pill 2 is shown cut in half.

With reference to FIG. 19C, an enlarged view taken from FIG. 19A, the alignment projection or point 26 on the shield portion 20B of the blade holding assembly 20 and the complimentary sloped guide receiving area 68 in the bottom housing 60 are illustrated. The alignment point 26 and receiving area 68, upon closing the device 10, engage each other and are provided to align the blade holding assembly 20 with the bottom housing 60 when the device 10 is closed to cut pills 2.

Figure 23A:
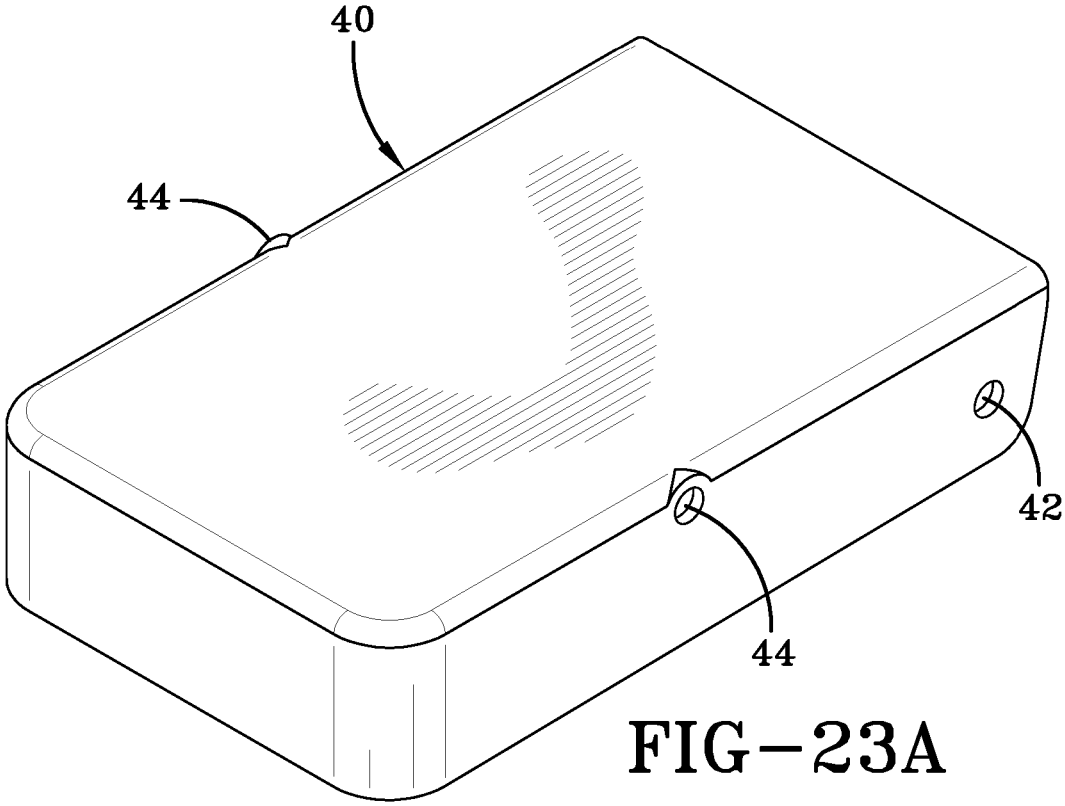
FIG. 23A is a top perspective view of the top housing.
Figure 23B:
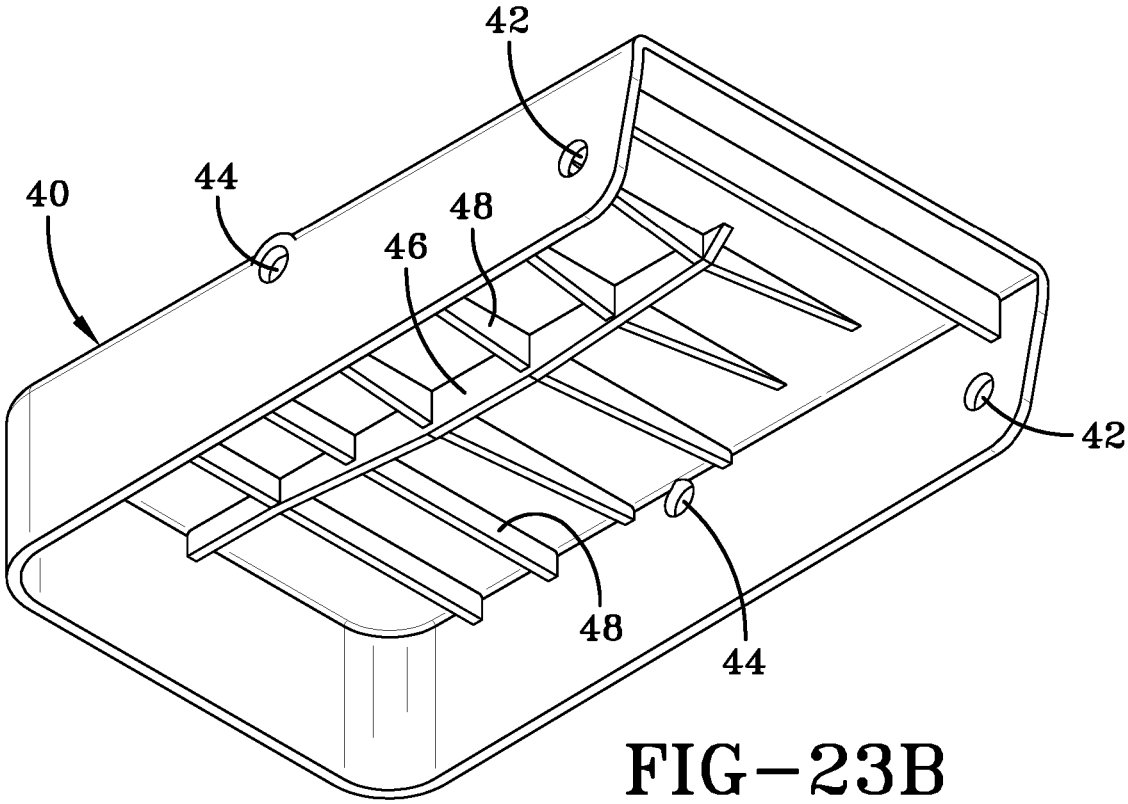
FIG. 23B is a bottom perspective view of the top housing.

To better understand how the top housing 40 is formed, a top perspective view of the top portion 40 is shown in FIG. 23A and a bottom perspective view is shown in FIG. 23B. As shown in the bottom perspective view 23B, the transverse ribs 48 structurally enhance the stiffening spine 46 so it is fully and rigidly supported from its central location inside the top housing 40. The pivot holes 42 and 44 are clearly shown.

Figure 24A:
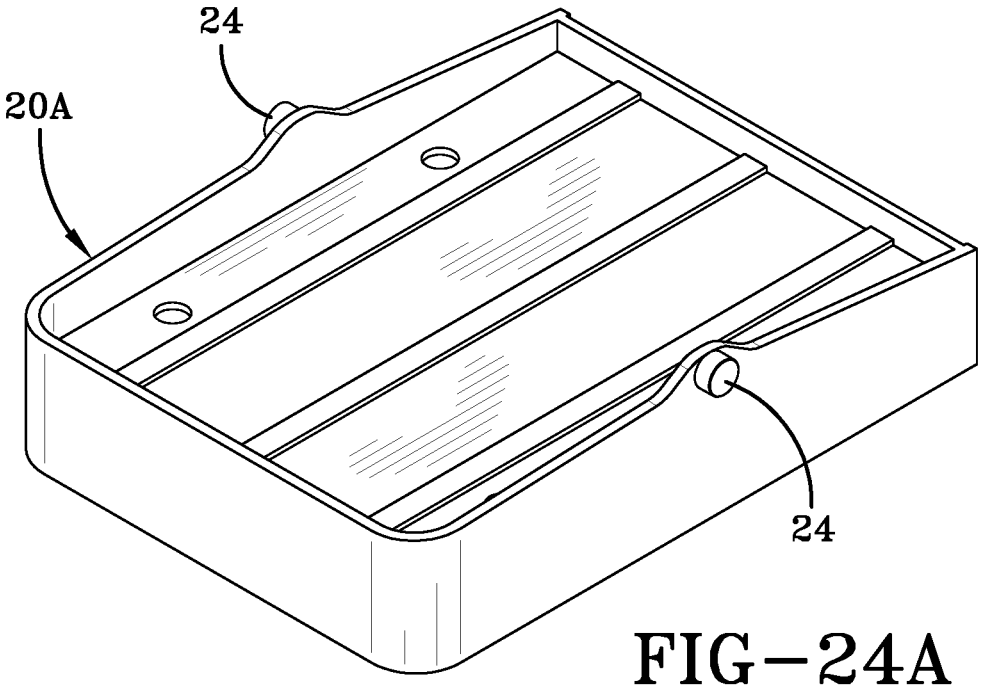
FIG. 24A is a top perspective view of the top portion of the blade holding assembly.
Figure 24B:
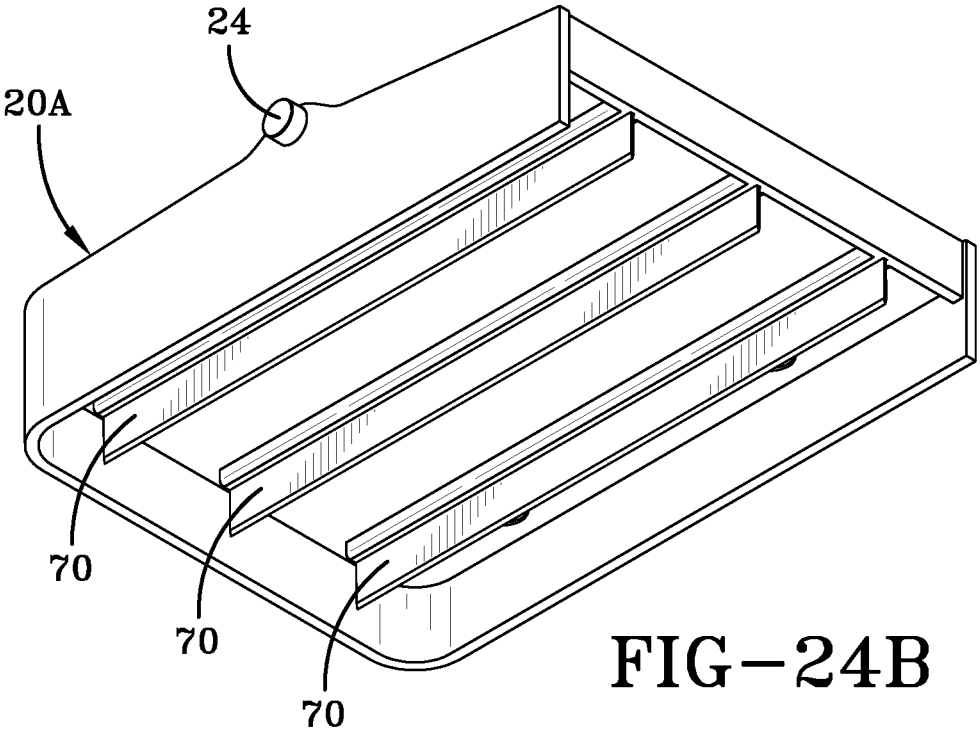
FIG. 24B is bottom perspective view of the top portion of the blade holding assembly.
Figure 25A:
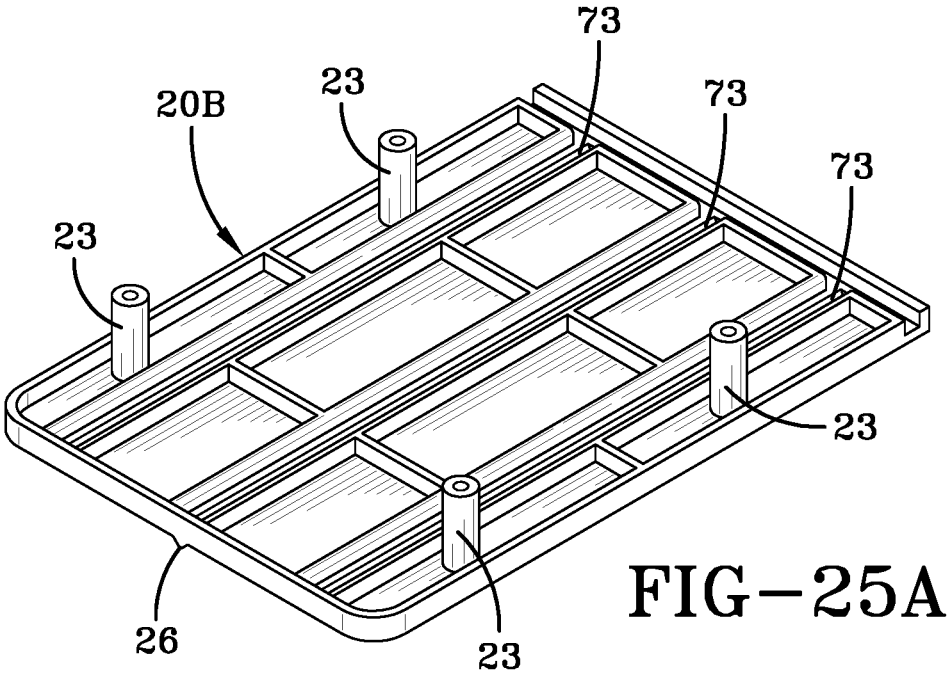
FIG. 25A is a top perspective view of the blade shield of the blade holding assembly.
Figure 25B:
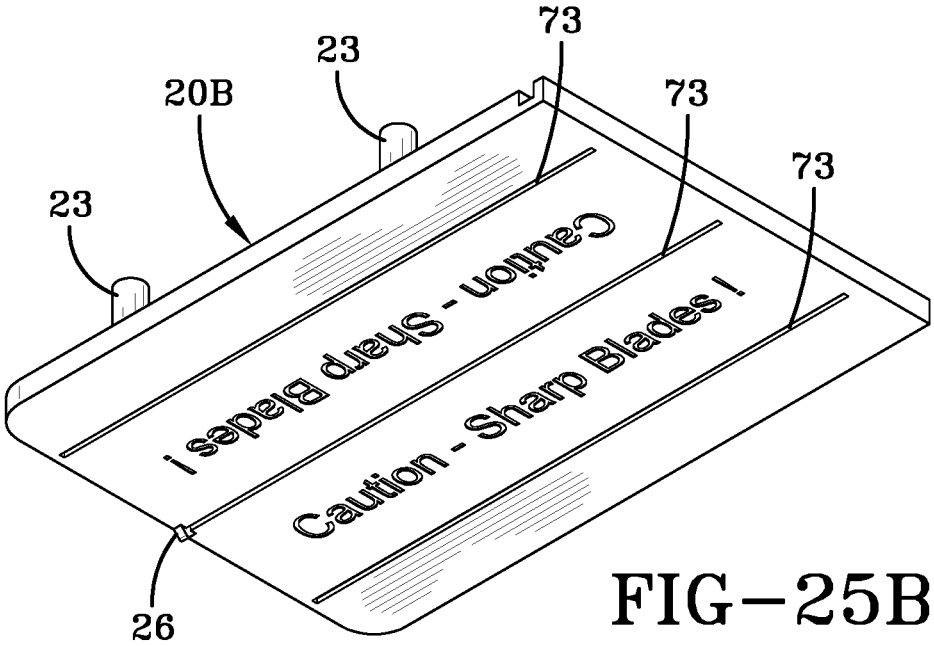
FIG. 25B is a bottom perspective view of the blade shield of the blade holding assembly.

With reference to the blade holding assembly 20, the pivot 24 is shown in the top portion 20A in FIGS. 24A and 24B. FIG. 24B shows an inside view looking upward into the blade holding assembly 20 top portion 20A wherein the blades 70 are shown rigidly attached to the top portion 20A. The shield portion 20B is illustrated in FIGS. 25A and 25B. the blade shield on the outer surface has words of indicia, "Caution—Sharp Blades!", shown embossed or molded into the surface of the shield 20B. The posts 23 are illustrated that are configured to fit through openings 25 in the top portion 20A allowing the shield portion to compress, thus exposing the blades 70.

The blade cutting assembly 20 is configured to accept a variety of size and shape of pills. It is recommended that one size and shape is used at a time. It is believed preferable that the blades 70 engage pills 2 of the same size and shape such that the initial contact of the blades 70 occurs simultaneously on all the pills 2 at the same location. The inclination of the bottom of the pill openings 61 at the inclinations 66A and 66B allow the pills 2 to be oriented on a slight inclination. If all the same size and shape pills are used, such as circular or round, the device 10 can be tilted aft so that all the circular or round pills are resting in the bottom portion of the openings 61 with the circular or round walls guiding the pills 2 to center themselves over the slotted channels 63. When this occurs the circular or round pills 2 are precisely oriented such that the blade 70 will cut them into two equal pieces as the top is closed. Interestingly, because the blade holding assembly 20 is on a pivot, as it engages the top surface 65 of the bottom housing 60, the blades 70 will maintain an orientation that is substantially parallel to this surface 65 as it engages the pills 2. The pills 2 will be angularly cut from a first location towards the bottom from initial upper location as they are resting on the inclined bottom 66A, 66B down to the lower portion on an angle. However, the blades will approach the pills horizontally relative to the device 10 in such a fashion that all the pills 2 are simultaneously contacted if they are the same size and shape.

When an elongated pill is positioned in the device 10, it is put in a forward portion of the pill opening 61 so that it lays against the flat portion of the opening 61 resting on the inclined bottom 66B inclined oppositely compared to the circular or round pills 2 previously discussed. In this position, the device can be partially closed when the pills are loaded and tilted towards a forward or frontal end of the open device opposite the pivoting end. When this occurs, the elongated pills 2 are resting against the walls of the openings 61 in such a way that they too are centered. When this occurs, the pills can be easily cut ensuring the pills 2 are cut into equal halves.

This unique cutting of the device 10 is enhanced by the structural enhancement of the top housing 40 ribs 48 and the stiffening spine 46 that drives the blade holding assembly 20 into a cutting engagement of the pills 2 as the shield 20B is pushed upward into the blade holding assembly 20 as the blades 70 enter into the slotted channels 63 as shown in FIG. 20B. This cutting device 10 is believed to be unique in the way in which the pills 2 are held on an incline, the way in which the pills 2 are centered on the channels 63 and the way in which the blades 70 are exposed due to compression of a pivoting blade holding assembly 20 held in the top housing 40. While the device 10 is shown with 3 rows it is believed the device 10 could be made with a single row or any number of rows.

As shown in FIGS. 18A, 18B and 19A, 19B and in FIGS. 20A-20C, the entire cutting force is achieved by pushing the top housing 40 toward the bottom housing 60 using the palm of the hand or by bearing down on the device with the weight of the operator or by squeezing the top and bottom housings 40, 60 together causing the pivots 24 to press against the blade holding assembly 20. This allows the device 10 to be placed on a flat, hard surface to cut as many as 15 pills with relative ease. There are no bulky external levers or clamps required and the device 10 can easily be contained in a purse or handbag due to its compact rectangular shape.

FIGS. 21 and 22 illustrate the cut pills 2 of a circular or round shape and an elongated caplet shape respectively. FIGS. 23A and 23B show the top perspective view and bottom perspective view of the top housing 40 respectively. FIG. 23B shows the longitudinal stiffening spine 46 with the transverse ribs 48. FIGS. 24A and 24B show the top and bottom of the blade holding assembly 20 top portion 20A. FIGS. 25A and 25B show the top and bottom of the blade shield 20B of the blade holding assembly 20.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A multiple pill cutting device comprises:

a pivoting housing structure having a top housing pivotably connected at one end to a bottom housing, the bottom housing having a plurality of pill holding openings arranged in one or more rows, the one or more rows of pill holding openings each have a slotted channel extending along a length of the bottom housing through and bisecting each pill holding opening configured to receive a pill cutting blade; and a blade holding assembly interposed between the top housing and the bottom housing, the blade holding assembly having one or more extending cutting blades, the at least one blade configured to align respectively with the one or more slotted channels when the top housing pivots closing onto the bottom housing moving the one or more cutting blades of the blade holding assembly to enter the slotted channels and cut pills held in the pill holding openings wherein each pill holding opening has a bifurcated sloped bottom having a pair of downward extending bottoms, each bottom being deepest at the first end or second end of the opening, a first bottom of said pair of bottoms being adjacent the first end and curved in a direction parallel to the at least one blade, and having a flat peripheral portion in order to support elongated pills and;

the second bottom of said pair of bottoms having an arcuate periphery to support circular or round shaped pills, wherein the sloped bottoms have the pills inclined or tilted in each pill holding opening.

2. The multiple pill cutting device of claim 1 wherein the one or more cutting blades are sharpened steel.

3. The multiple pill cutting device of claim 1 wherein the one or more cutting blades are stainless steel.

4. The multiple pill cutting device of claim 1 wherein the blade holding assembly further comprises:

an upper blade holding portion having the one or more cutting blades fixed thereto;

a lower blade shield portion with blade slots, one blade slot being aligned with each of the one or more cutting blades;

a plurality of fasteners connecting the upper blade holding portion to the lower blade shield portion at a plurality of attachment posts; and a plurality of springs encircling the plurality of attachment posts.

5. The multiple pill cutting device of claim 1 wherein upon closing the device, an alignment point on the shield portion engages a receiving area on the bottom housing to align the blade holding assembly with the bottom housing and the lower blade shield portion moves upwardly and compresses against the top surface of the bottom housing as the cutting blades enter the slotted channels to cut the pills.

6. The multiple pill cutting device of claim 1 wherein the blade holding assembly is affixed to the top housing at a pivot location.

7. The multiple pill cutting device of claim 6 wherein the pivot location is positioned between longitudinal ends of the blade holding assembly.

8. The multiple pill cutting device of claim 7 wherein the pivot location is located midway relative to the longitudinal ends.

9. The multiple pill cutting device of claim 8 wherein the blade holding assembly moves relative to the top housing about the pivot location upon cutting the pills.

10. The multiple pill cutting device of claim 1 wherein the top housing has a contoured stiffening spine projecting and extending from inside the top housing for reinforcing the top housing as the pivot pins are pushed by the pivot holes of the top housing pushing against the upper blade holding portion of the blade holding assembly.

11. The multiple pill cutting device of claim 10 wherein the contoured stiffening spine has a contour allowing the cutting blades to move parallel to the bottom housing of the device as the blade housing assembly pivots relative to the top housing.

12. The multiple pill cutting device of claim 11 wherein the contoured stiffening spine and the top housing are reinforced by a plurality of transverse ribs.

13. The multiple pill cutting device of claim 12 wherein the one or more cutting blades are configured to cut pills simultaneously when the pills are all of a same size and a same shape.

14. The multiple pill cutting device of claim 13 wherein the one or more cutting blades engage the nested pills horizontally relative to the bottom housing and cut the pills on an angular cut due to the sloped bottom of each pill holding opening.

15. The multiple pill cutting device of claim 1 wherein the device, when loaded with elongated pills, is tilted toward the flat portion of the opening, the pills nest in the pill holding openings and center about the slotted channel.

16. The multiple pill cutting device of claim 1 wherein the device, when loaded with circular or round pills, is tilted toward the arcuate peripheries of the openings, the pills nest in the pill holding openings and center about the slotted channel.

17. The multiple pill cutting device of claim 1 wherein the pivoting housing structure and blade holding assembly are injection molded plastics.

18. The multiple pill cutting device of claim 1 wherein the injection molded parts are made from high density polyethylene or similar plastic material.

* * * * *